US005857531A

United States Patent [19]

Estep et al.

[11] Patent Number: 5,857,531

[45] Date of Patent: Jan. 12, 1999

[54] BOTTOM HOLE ASSEMBLY FOR DIRECTIONAL DRILLING

[75] Inventors: James Estep, Houston; Lance D. Underwood, Cypress; Albert Odell, Houston, all of Tex.

[73] Assignee: Halliburton Energy Services, Inc., Houston, Tex.

[21] Appl. No.: 844,489

[22] Filed: Apr. 18, 1997

Related U.S. Application Data

[60] Provisional application No. 60/043,881 Apr. 10, 1997.

[51] Int. Cl. [6] ..... E21B 7/08

[52] U.S. Cl. ..... 175/75; 175/101

[58] Field of Search ..... 175/107, 61, 74, 175/75, 101, 26

[56] References Cited

U.S. PATENT DOCUMENTS

| | | | |
|---|---|---|---|
| 4,059,165 | 11/1977 | Clark | 175/107 |
| 4,679,638 | 7/1987 | Eppink | 175/107 |
| 4,991,668 | 2/1991 | Rehm et al. | 175/61 |
| 5,135,059 | 8/1992 | Turner et al. | 175/101 |
| 5,269,383 | 12/1993 | Forrest | 175/26 |
| 5,311,952 | 5/1994 | Eddison et al. | 175/61 |
| 5,368,108 | 11/1994 | Aldred et al. | 175/40 |
| 5,396,966 | 3/1995 | Roos, Jr. et al. | 175/45 |
| 5,474,334 | 12/1995 | Eppink | 285/184 |
| 5,538,091 | 7/1996 | Theocharopoulos | 175/61 |
| 5,620,056 | 4/1997 | Eppink | 175/95 |

*Primary Examiner*—Frank Tsay
*Attorney, Agent, or Firm*—Conley, Rose & Tayon, P.C.

[57] ABSTRACT

The bottom hole assembly of the present invention includes a drill bit driven by a positive displacement drilling motor, the motor being constructed of tubular housings, one of said housings having a bend so as to cause the bit to drill directionally, another housing containing a rotor and stator to generate power, and a flexible section between the power generation housing and the bend. A stabilizer is disposed on one end of the flexible section for engaging the wall of the borehole and the housing with the bend includes a wear pad for engaging the lower side of the borehole. The bottom hole assembly contacts the borehole at three contact points, namely at the stabilizer, the wear pad, and the drill bit, for producing the necessary build-up rate, along with the bend, and thus the curvature of the borehole being drilled. The flexible section has a stiffness which is less than the stiffness of the housing of the stator and has a stiffness which is on the order of 33% or less of that of the power generation housing. The stiffness is determined by the selection of the material, wall thickness and length of the flexible section such that the desired flexibility is achieved, but the necessary torsional strength and axial load capabilities are maintained. The purpose of the flexible section is to allow the bottom hole assembly to be configured to achieve high build rates, on the order of 20 to 70 degrees per hundred feet, without generating excessively high loads and stresses on the bit and other bottom hole assembly components.

19 Claims, 10 Drawing Sheets

BOTTOM HOLE ASSEMBLY FOR DIRECTIONAL DRILLING

CROSS-REFERENCE TO RELATED APPLICATION

The present application claims the benefit of 35 U.S.C. 111(b) provisional application Ser. No. 60/043,881 filed Apr. 10, 1997 and entitled "Bottom Hole Assembly".

BACKGROUND OF THE INVENTION

Directional control in most controlled-trajectory drilling is provided by two basic types of bottom hole assemblies: drilling motors and rotary assemblies. Rotary assemblies are used for maintaining the direction of a well-bore or for making minor changes in direction. Drilling motors are used for making rapid changes in direction. The positive displacement motor is a fluid-driven motor which turns the drill bit independently of drill string rotation. Examples of positive displacement motors are described in U.S. Pat. Nos. 4,059,165 and 4,679,638. The power of a positive displacement motor is generated by a power generation section that includes a rotor and stator which have helical lobes that mesh to form sealed helical cavities. When drilling fluid is pumped through the positive displacement motor, the fluid advancing through the cavities forces the rotor to rotate.

The rotor, which travels in an orbiting motion about the axis of the tool, is connected to either a flexible or articulated constant velocity coupling which transmits torque while eliminating the orbital motion. The coupling then transmits the torque to a driveshaft, which is housed in bearings to enable it to transmit both axial (i.e. "bit weight") and lateral loads from the drill string to the bit. A tandem motor may also be used which includes upper and lower power sections. Such a tandem motor is described in U.S. Pat. No. 5,620,056 issued Apr. 15, 1997, incorporated herein by reference.

A steerable motor, typically configured with a bend in the external housing and two or more stabilizers, is a positive displacement motor configured to operate as a two-mode system. In the "sliding" mode, the steerable motor is oriented by rotating the drill string, using measurement-while-drilling signals to determine toolface or bend orientation. Once the desired downhole toolface orientation is achieved, the drill string is then advanced without rotating, maintaining the desired toolface, using only the rotation generated by the positive displacement motor to drive the bit. The combination of stabilizers and bent housing generates a side load on the bit, causing it to drill in the toolface direction. Pads on the motor housing may be used instead of stabilizers. In the "rotating" mode, the entire motor is rotated, negating the effect of the bend, and its directional characteristics are determined by the size and placement of stabilizers.

FIG. 1 illustrates a simple well with a lateral borehole A. The kick-off point B is the beginning of the build section C. A build section is preferably performed at a constant build-up rate until the desired angle or end-of-build D is achieved. Build-up rate is normally expressed in terms of degrees-per-hundred-feet (deg/100'), which is simply the measured change in angle divided by the measured depth drilled.

The build section C is formed by the build-up rate of the positive displacement motor which creates lateral borehole A having a curvature with a radius. Conventional, or long radius boreholes typically are those with build-up rates between 1 and 8 degrees per 100 feet. Medium radius boreholes typically are those with build-up rates between 8 and 30 degrees per 100 feet and short radius boreholes typically are those with build-up rates over 60 degrees per 100 feet.

The build rate, or angle-changing capability of a motor, depends on the extent to which the combination of bend and stabilizers and/or pads cause the bit to be offset from the center line of a straight borehole. Increased bit offset results in higher build rate. Increased bit offset, however, results in increased side loads, as shown in FIG. 2, when kicking off or when the motor is rotated in the borehole. High bit side loads can cause damage to the gage or bearings of the bit, and limit motor life by causing driveshaft fatigue, radial bearing wear, and stator damage. Stabilizer loads and associated wear also increase.

Medium radius wells use many of the same bottom hole assembly components and well planning tools used in long radius wells. The key differences are that medium radius build rates place some limitations on the ability to rotate, and that these limitations can affect well profile. Medium radius wells may be broadly characterized by the following: the bottom hole assembly used to drill the build section cannot be rotated in that section (or at best, very limited rotation) and due to the hole curvature in the build, the component of drill pipe stress due to bending is high enough that either the stress component due to tension must be limited by well profile design or drill string rotation must be limited while in tension.

The definition of medium radius, like that of long radius, will vary with hole size. The following are approximate guidelines:

| Hole Size | Build Rate (Degrees/100') |
|---|---|
| 6" to 6¾" | 12 to 25 |
| 8½" | 10 to 18 |
| 12¼" | 8 to 14 |

Since the motor used to drill the build section is not intended to be rotated, its configuration is somewhat different than that of a steerable motor. The stabilizers which give a steerable motor its rotating-mode directional tendencies are not needed, and in fact reduce the ability of the motor to slide, so they are typically not used. The first contact point of a medium radius bottom hole assembly is generally a pad or sleeve instead of a stabilizer, and is usually designed close to the bend to maximize the build rate capability.

Depending on hole curvature and bottom hole assembly design, it may be possible to alter the build rate while drilling in the build section without tripping for a bottom hole assembly change. As in long radius drilling, the bottom hole assembly is designed to build angle at a higher rate than necessary, then variations of steerable motor techniques are used to reduce the build rate. One method of reducing the build rate is to rotate the drill string very slowly, on the order of 1 to 10 RPM. This method is referred to as pigtailing because of the corkscrewed hole it would seem to produce. Another method, known as "rocking" or "wagging" toolface, is to orient left for some interval, then right for an equal interval. Both of these techniques can be used to make an aggressive angle-build bottom hole assembly drill a tangent-like trajectory, especially when viewed in the vertical plane. However, these practices may cause excessive stress in motor or measurement-while-drilling housings when passing through the high doglegs created.

Short radius wells may be generally characterized by the fact that hole curvature is so high that the bottom hole assembly must be articulated in order to pass through the build section. The following may be considered to define short radius:

| Hole Size Radius (feet) | Build Rate (degrees/100') | Radius (feet) |
|---|---|---|
| 8½" | 48–88 | 120 to 65 |
| 6" to 6¾" | 57–115 | 100 to 50 |
| 4¾" | 64–143 | 90 to 40 |
| 3¾" | 72–191 | 80 to 30 |

The build rate of short radius wells is such that large diameter tubulars, such as motors or survey collars, must be articulated in order to pass through the build section. Articulations are knuckle joints or hinge points which transmit axial loads, but not bending moment. Bottom hole assembly components are shortened into lengths which will traverse through the build without interference. Without articulations, excessive bending stress and high side loads would result.

Since the articulated joints decouple bending moment from one section of the bottom hole assembly to another, the build rate of the steering section is unaffected by the stiffness or weight of the sections above it. Build rate is completely defined by the three contact points defined by the bit, the first stabilizer or pad, and the first articulation point. The overall length and offset of these components must be such that the assembly will pass through casing with a reasonable amount of force.

Bottom hole assembly modeling is used in medium radius boreholes to analyze forces on the bit and stabilizers, and bending stresses at connections and critical cross-section changes, with assemblies oriented in the model both high-side and lowside. Bottom hole assembly modeling is utilized in well planning for predicting the capabilities and tendencies of each bottom hole assembly that is planned to be run. Bottom hole assembly modeling identifies the response of each bottom hole assembly to variation in operating parameters such as weight on bit, overgage or undergage hole, stabilizer wear, and formation tendencies.

Various types of directional prediction models exist, as are well known by one skilled in the art, but all are based on the principle that directional control is accomplished by applying forces to the bit that will cause the bit to drill in the desired direction. Two kinds of models are commonly used, equilibrium curvature models and "drill ahead" models. Equilibrium curvature models are static beam models which solve for the hole curvature in which all bending moments and forces on the beam are in equilibrium. A typical 2-dimensional model applies known loads (including weight-on-bit, buoyancy, and the weight of the bottom hole assembly itself) and derived loads (i.e. bit side loads due to formation anisotropy) to the bottom hole assembly components.

A gap in radius exists between the lower (in terms of build-up rate) limit of short radius and the upper limit of medium radius. This gap between medium and short radius build rates has become known as intermediate radius, typically considered to be in the range of 25 to 60 degrees per 100 feet. For a 6" to 6¾" hole size, for example, this range would be about 25 to 57 deg/100'. In the intermediate radius range, drill pipe rotation is acceptable, but conventional medium radius motors cannot achieve the necessary build rates. For conventional medium radius motors to achieve build rates in this intermediate range, extremely high bend angles have to be used. Such high bend angles produce so much bit interference with the casing that it is difficult or impossible to force the bottom hole assembly through the casing without damaging the bit. Also, at kickoff the bit side load would be so high the motor driveshaft would be in danger of breaking. If the kickoff could be initiated successfully, the bottom hole assembly tends to bind in the curve and has trouble sliding. Conventional bottom hole assemblies have other fundamental limitations in achieving a build rate for an intermediate radius well. Conventional bottom hole assemblies are relatively stiff and have a size which takes up most of the borehole. For example, a 4¾ downhole motor drills a 6 to 6¾ inch hole leaving little clearance for the bottom hole assembly. Because the bottom hole assembly is much stiffer than the drill string, the bottom hole assembly will only pass through a borehole with a maximum curvature without breaking one of its components. For a 4¾ motor, the stiffness of the bottom hole assembly generally limits the build-up rate to 25 degrees per 100 feet to still be able to pass the bottom hole assembly and MWD collars through the curved borehole. There are also limitations on rotation in the borehole. The drill strings can be rotated through higher curvatures than can the bottom hole assemblies because the reduced diameter of the drill string causes it to be more flexible. The 3½" drill string which is used with the 4¾" motor may be safely rotated through a build-up rate of up to 60 degrees per 100 feet.

There is a need to be able to drill intermediate radius wells without using special bottom hole assemblies. Drilling the short radius well limits the amount of drilling time and thus expense required for the borehole. However, drilling a short radius well instead of an intermediate radius well has disadvantages. In drilling a short radius well, there is the potential for the yielding of the drill string. Also, there is almost no production equipment, such as screens and liners, that can pass through and around bends greater than 60 deg/100'. This is possible in bends between 20 and 60 deg/100'. Thus, there are more production and completion options available in an intermediate radius well. Short radius wells require special drilling components. To allow bottom hole assemblies to pass through a short radius well having a build-up rate above 60 deg/100', the sections of the bottom hole assembly must be very short and articulated between the sections. The drill string cannot be rotated and is slid through the borehole. Articulated motors have also suffer from unpredictable build-up rates in this range, especially in unconsolidated formations.

Flexible members have been used with rotary drilling assemblies. U.S. Pat. No. 5,538,091 discloses a bottom hole assembly for connection to a drill string for use in directing the path of a drill bit while rotary drilling. The bottom hole assembly includes a modified cutting assembly, a stabilizer, and a flexible member interposed between the modified cutting assembly and stabilizer for drilling a predetermined portion of the hole. The modified cutting assembly may include a symmetric drill-bit assembly and a bent sub or a drill bit having cutters with a non-radially symmetric pattern. The flexible member is made of a material having a lower Young's modulus than steel and/or a member with a smaller wall thickness than the remainder of the bottom hole assembly. The flexible member may be provided by an aluminum drill collar or a composite material drill collar. Additionally, the flexible member may be an articulated member. That portion of the bottom hole assembly below the stabilizer is designed so that portion does not sag to the extent that it contacts the borehole wall when the drill string is inclined to vertical.

Further, it is known to place "compressive service" drill pipe or reduced diameter collars between the drilling assembly and drill collars to reduce stress on the drilling assembly. However, placing the flexible member above the collars relieves stress at the top of the motor but does not adequately relieve bit side loads. Placing the flexible member above the motor also does not have the desired effect of increasing build rates while preventing the motor from binding in the curved wellbore.

The bottom hole assembly of the present invention overcomes the deficiencies of the prior art.

SUMMARY OF THE INVENTION

The bottom hole assembly of the present invention includes a drill bit driven by a positive displacement drilling motor, the motor being constructed of tubular housings, one of said housings having a bend so as to cause the bit to drill directionally, another housing containing a rotor and stator to generate power, and a flexible section between the power generation housing and the bend. A stabilizer may be disposed on one end of the flexible section for engaging the wall of the borehole and the bent housing includes a wear pad for engaging the lower side of the borehole. The bottom hole assembly contacts the borehole at three contact points, namely at the stabilizer, the wear pad, and the drill bit, for producing the necessary build-up rate, along with the bent housing, and thus the curvature of the borehole being drilled. The purpose of the flexible section is to allow the bottom hole assembly to be configured to achieve high build rates, on the order of 20 to 70 degrees per hundred feet, without generating excessively high loads and stresses on the bit and other bottom hole assembly components. The flexible section also allows the bottom hole assembly to flex to one side of the hole in order to increase build rate capability. The flexible section has a stiffness which is on the order of 33% or less of that of the power generation housing. The flexibility of the flexible section is achieved through the selection of material and reduced diameter such that the desired flexibility is achieved, but the necessary torsional strength and axial load capabilities are maintained.

The stiffness of the bottom hole assembly is reduced in a controlled and predictable manner for producing the required build-up rate by inserting the flexible section between the downhole motor and bent housing. The flexible section has a stiffness which is less than that of the other components of the bottom hole assembly so as to achieve a build-up rate that will produce an intermediate radius and yet withstand the bending stresses and side loads placed on the bottom hole assembly as the bottom hole assembly passes through the casing, kicks off to drill the intermediate radius borehole, and drills the curvature of the intermediate radius borehole.

The stiffness of the flexible section is predetermined by the material from which the flexible section is made, the tubular wall thickness determined by the inside and outside diameters of the tubular wall of the flexible section, and the length of the flexible section. Any or all of these parameters of the flexible section may be varied to produce the desired stiffness to provide a build-up rate which will drill an intermediate radius well. Because it is desirable to limit overall bottom hole assembly length, however, the greatest benefit is achieved by varying the material and diameters rather than adding length to the flexible section. One preferred material for the flexible section is beryllium copper which has a flexural modulus (Young's modulus) in the range of 30% to 63% of that of 4000 series steel which is typically used for the other components of the bottom hole assembly. The stiffness of the flexible section may be further reduced by reducing the tubular wall thickness such as by reducing the outside diameter or increasing the inside diameter or both of the tubular wall whereby the cross-section is less than that of the nominal wall thickness of the other components of the bottom hole assembly. Further, the flexible section may be lengthened to reduce stiffness.

The reduction of the stiffness of the flexible section, in conjunction with the calculated optimum placement of the bend in the bent housing and the control of the three contact points which determine the curvature of the borehole being drilled by the drill bit, result in many advantages over the prior art. The bottom hole assembly of the present invention has the advantage that it will drill a controlled curve of a predictable radius ranging from slightly less than, to as little as one-third of, the radius drillable with a downhole motor having a steel housing of uniform diameter. Further, the bottom hole assembly of the present invention reduces the side loads on the bottom hole assembly so as to reduce static and cyclic stress on the rotor shaft driving the bit resulting in a longer shaft life. The bottom hole assembly of the present invention also reduces the force required to pass a bottom hole assembly, which can achieve a high build rate, through the cased borehole and down to the kick off point for the intermediate radius borehole. The present invention also allows the bottom hole assembly to be rotated in wellbores of 30 degrees per 100 feet or less, allowing a degree of steerability or build-up rate control which has previously been unachievable.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
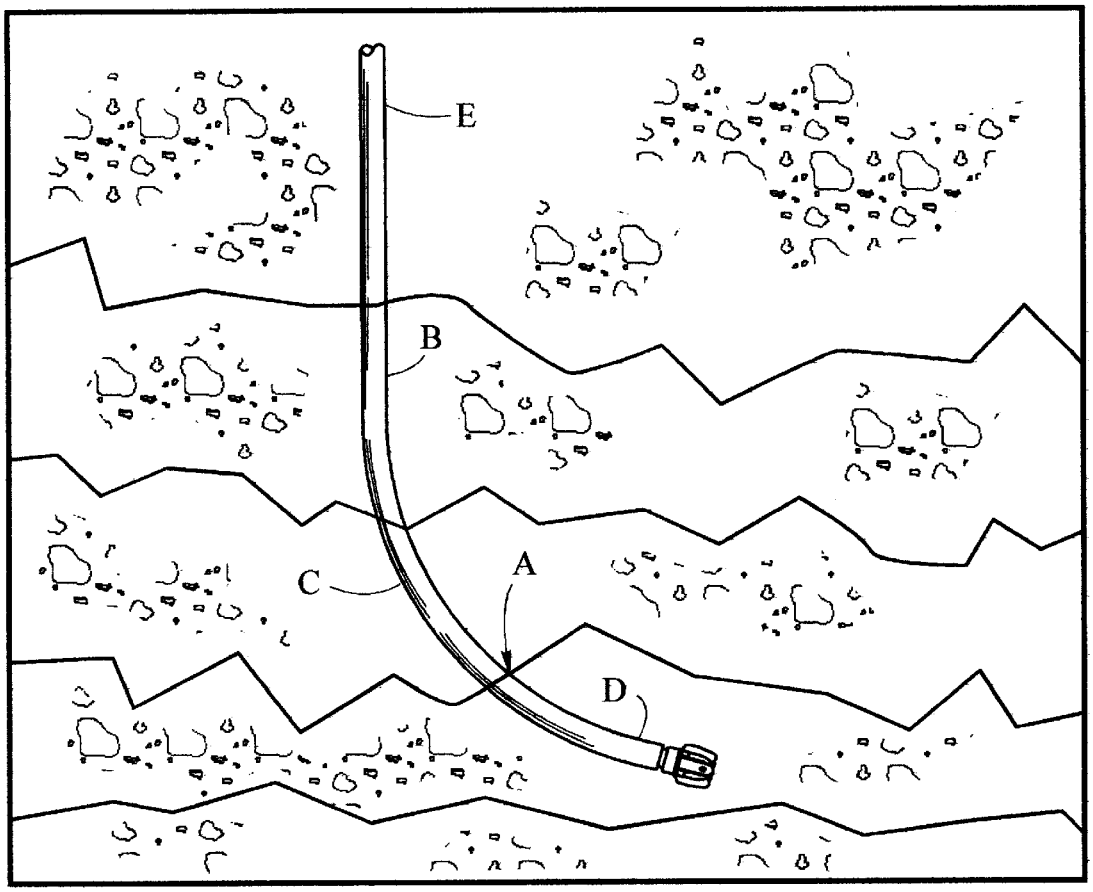
FIG. 1 is a schematic of a well profile.

Referring initially to FIG. 1, there is illustrated one type of well profile for use with the bottom hole assembly of the present invention. FIG. 1 illustrates a lateral borehole A which has an intermediate radius profile. The borehole A includes a kick-off point B at the beginning of the build section C which extends until the desired end-of-build D is achieved.

Figure 4:
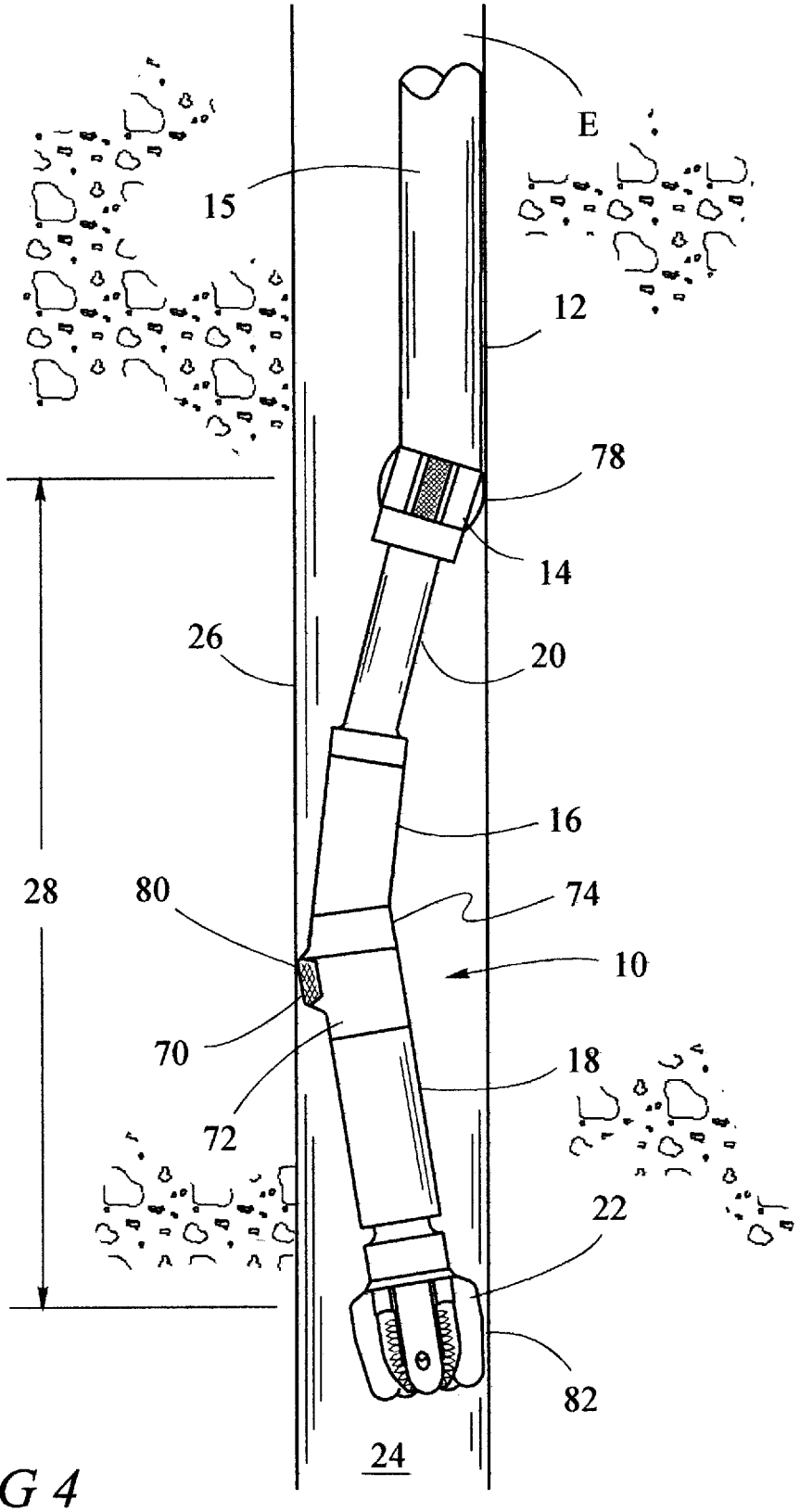
FIG. 4 illustrates the bottom hole assembly of the present invention passing through the casing.

Referring now to FIG. 4, the bottom hole assembly 10 of the present invention includes a drill bit 22 driven by a positive displacement drilling motor 12 having a tubular housing comprised of a plurality of sections or individual housings, namely a dump valve section or housing (not shown), at least one power generation section or housing 15, a flexible section or housing 20, a connector rod section or housing 16 typically referred as the bent housing, and a bearing section or housing 18. It should be appreciated that two or more of these sections or housings may be an integral part. The power generation section 15 includes a stator 36 in which is disposed a rotor 54. A stabilizer 14 is also disposed on bottom hole assembly 10. In FIG. 4, bottom hole assembly 10 is shown passing through the bore hole 24 of casing 26 with bent housing 16 forming a bend 74. The distance 28 between the stabilizer 14 and bit 22 is selected based on the desired build rate and formation anisotropy. The shorter that distance the greater the build-up rate.

Figure 6:
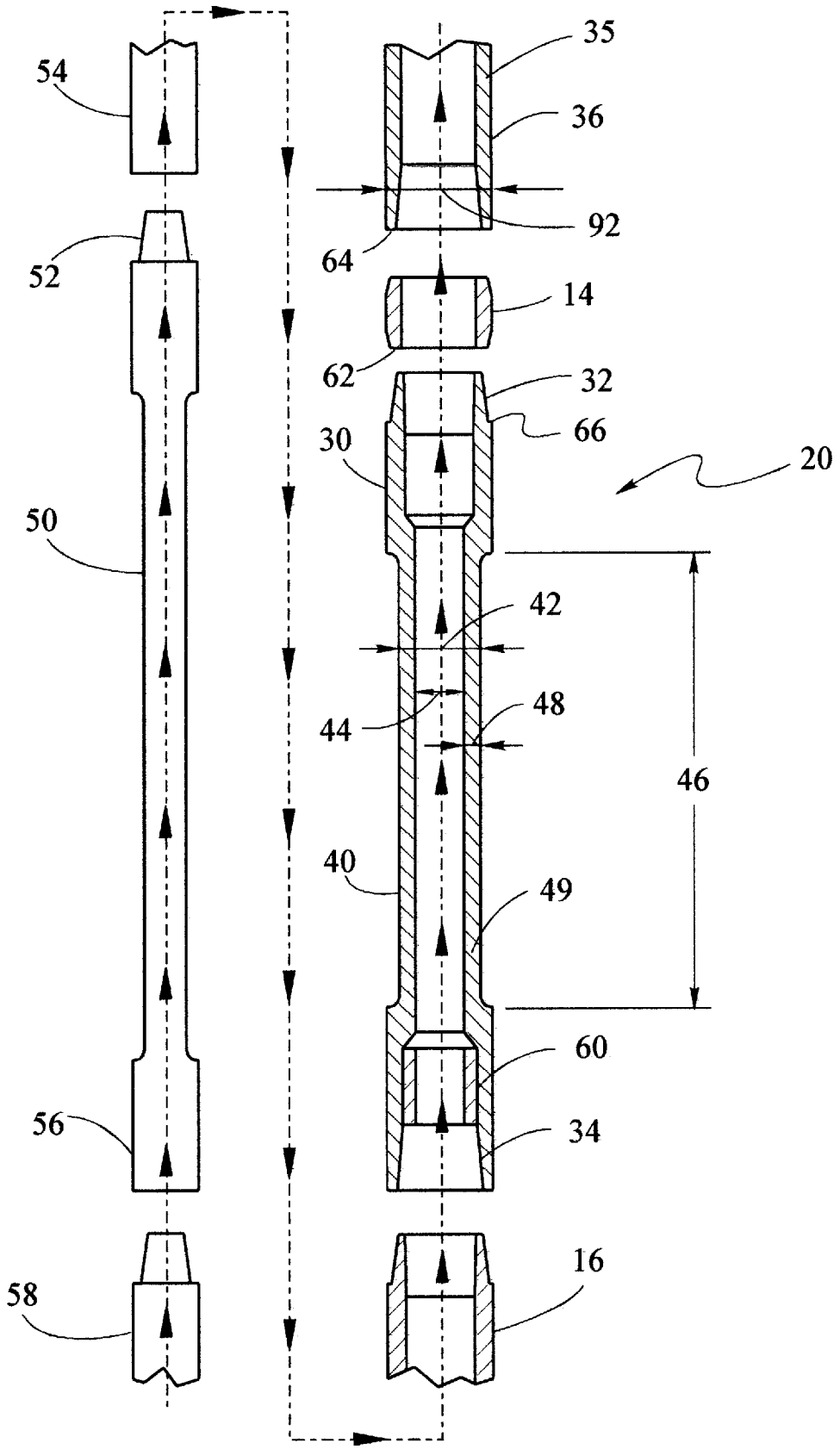
FIG. 6 is an exploded view partly in cross-section, of the flexible joint of the present invention.
Figure 11:
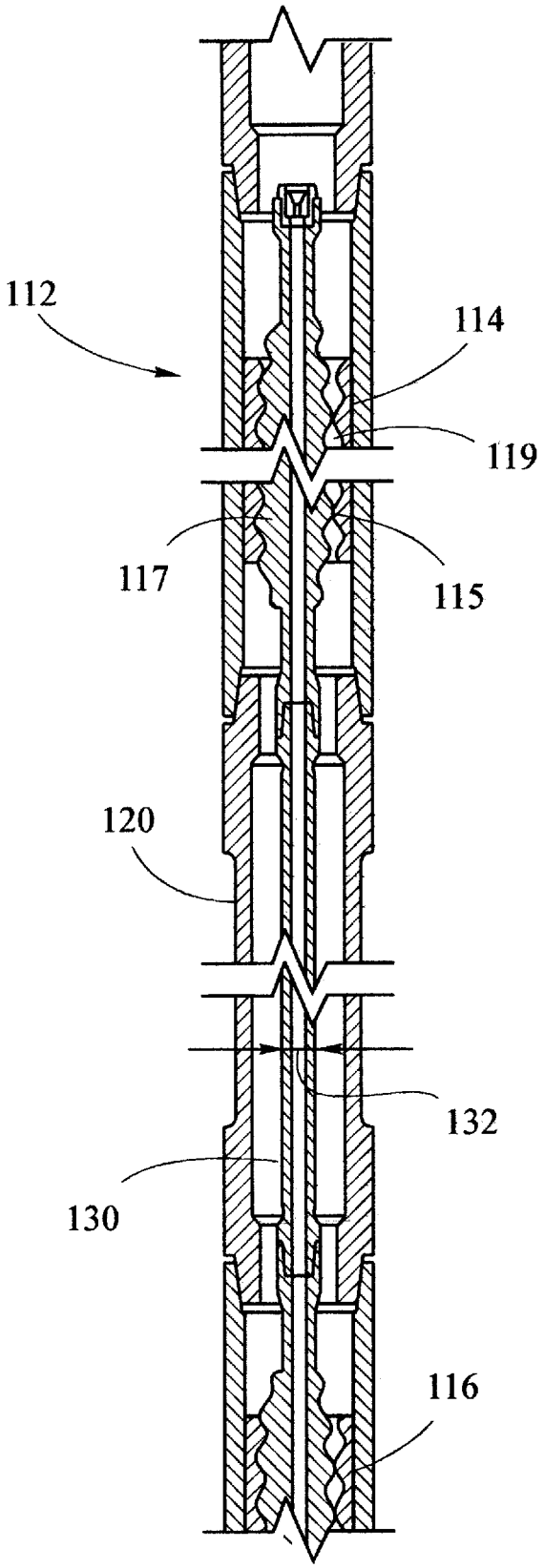
FIG. 11 is an enlarged elevation view in cross-section of the tandem motor with flexible section and flexible rotor of FIG. 10.

Referring now to FIG. 6, stator 36 includes a tubular housing 35, typically made of 4000 series steel, having rubber helical lobes, such as helical lobes 115 shown in FIG. 11, bonded to the inner diameter of stator housing 35. Likewise, rotor 54 has rubber helical lobes, such as lobes 117 shown in FIG. 11, bonded to its outer diameter to form cavities, such as cavities 119 shown in FIG. 11. The stator 36 and rotor 54 generate the power for motor 12 as the fluid passing through the cavities forces the rotor 54 to rotate.

The flexible section 20 of bottom hole assembly 10 is disposed between the power generation section or housing 15 and the bend 74. Flexible section 20 includes a tubular housing 30 having a threaded pin member 32 on one end and a threaded box 34 on its other end. Pin and box ends 32, 34 are sized for achieving rotary shouldered threaded connections with the stator housing 35 of power generation section 15 and the upper end of bent housing 16, respectively. Housing 30 includes a reduced diameter portion 40 having an outside diameter 42, an inside diameter 44, and a length 46. The outside diameter 42, inside diameter 44, and length 46 are determined as hereinafter described in further detail.

Further, housing 30 is made of a material which has a predetermined stiffness and which can withstand high stress applications. Housing 30 is preferably made of beryllium copper and may be made of titanium, although titanium is more expensive. Further, housing 30 may be made of aluminum or 4330 steel in certain applications, although less preferred. The material is selected based on its Young's modulus.

The bottom hole assembly 10 includes an internal drive train of rotor 54, a rotor torsion bar, extension shaft 50, and a U joint or constant velocity joint 58. Rotor extension shaft 50 is disposed within flexible section 20 and includes a threaded pin end 52 for connection to the lower end of rotor 54 of power generation section 15 and a lower threaded head 56 for threaded engagement to the constant velocity joint 58 located within connector rod or bent housing 16. The rotor extension shaft 50 has a reduced diameter sized to withstand the hydraulic thrust from the power generation section 15 and the torsional and bending loads placed on the shaft 50 by rotor 54. The rotor extension shaft 50 is a highly stressed component and must have sufficient thickness to withstand these loads. Typically, the rotor extension shaft is made of stainless steel. The diameter of rotor extension shaft 50 is reduced to the minimum required for handling these loads to allow the inside diameter 44 of flexible section 20 to also be reduced and still allow adequate flow through the power generation section 15. The reduction of inside diameter 44 allows a reduction in the cross-sectional area 48 of the annular wall 49 of flexible section 20 thereby reducing stiffness and adding flexibility to flexible section 20.

In a conventional bottom hole assembly, the rotor connects directly to a connecting rod in the connector rod housing. But in the present invention the rotor 54 is connected to the rotor extension shaft 50 which passes through flexible section 20. The rotor 54 has eccentric rotation and pushes on rotor extension shaft 50 at an angle applying an axial compression on shaft 50. The coupling or connection between head 56 and constant velocity joint 58 then allows lateral movement of the head 56 of rotor extension shaft 50 within box end 56 of flexible section 20 causing shaft 50 to engage the inside of box end 34 of flexible section 20. A rotor spacing bushing 60 is disposed within box end 34 of flexible housing 30 to stabilize the head 56 of shaft 50 and prevent wear on box end 34 due to rotor extension shaft 56. Rotor spacing bushing 60 is preferably made of stainless steel.

Figure 7:
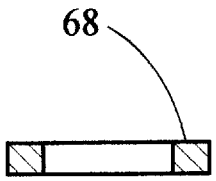
FIG. 7 is a cross-section view of a spacer ring for the flexible joint of FIG. 5.

Centralizer or stabilizer 14 is disposed on the uphole end of flexible section 20 at the connection between pin end 32 and stator housing 35. Stabilizer 14 includes an inwardly directed annular flange 62 which, upon assembly, is clamped between the terminal end 64 of stator housing 35 and the rotary shoulder 66 of pin 32 of flexible section 20 thereby disposing stabilizer 14 around the connection of pin end 32 and stator housing 35. It should be understood that stabilizer 14 need not be an annular member and may be a wear pad on the lower side of either the lower end of stator housing 35 or the upper end of flexible section 20. Further, in some applications, the stabilizer may be integral to the flexible section 20 or may be unnecessary. When the stabilizer 14 is not used, a spacer ring 68, shown in FIG. 7, is disposed between the terminal end 64 of stator housing 35 and the rotary shoulder 66 of pin 32 of flexible section 20 to bridge the gap left by annular shoulder 62 of stabilizer 14. It should also be appreciated that the stabilizer 14 may be located below the flexible section 20 on the downhole end of section 20.

Referring again to FIGS. 4 and 5, the bent housing 16 is a conventional bent housing such as that disclosed in U.S. Pat. No. 5,474,334, incorporated herein by reference. A connector rod (not shown) extends through bent housing 16 and is connected to bearing assembly 18. The bent housing 16 may have an adjustable bend angle, typically from zero to 3 degrees. The bent housing 16 of the bottom hole assembly 10 of the present invention has a wear pad 68 disposed on the exterior of housing 72 adjacent to the bend 74 for engaging the lower side 76 of borehole A.

As shown in FIG. 4, high stresses are applied to bottom hole assembly 10 due to the side loads placed on the assembly 10 as it passes through casing 26. Bent housing 16 causes bottom hole assembly 10 to contact casing 26 at point 78 where stabilizer 14 engages casing 26, point 80 where the wear pad 70 of bent housing 16 contacts casing 26, and point 82 where bit 22 contacts casing 26. Depending upon the bend angle 74 of bent housing 16, the points of contact 78, 80, 82 cause casing 26 to apply these side loads to bottom hole assembly 10. The greater the bend angle of bent housing 16 and the greater the build-up rate, the greater the side loads.

Figure 5:
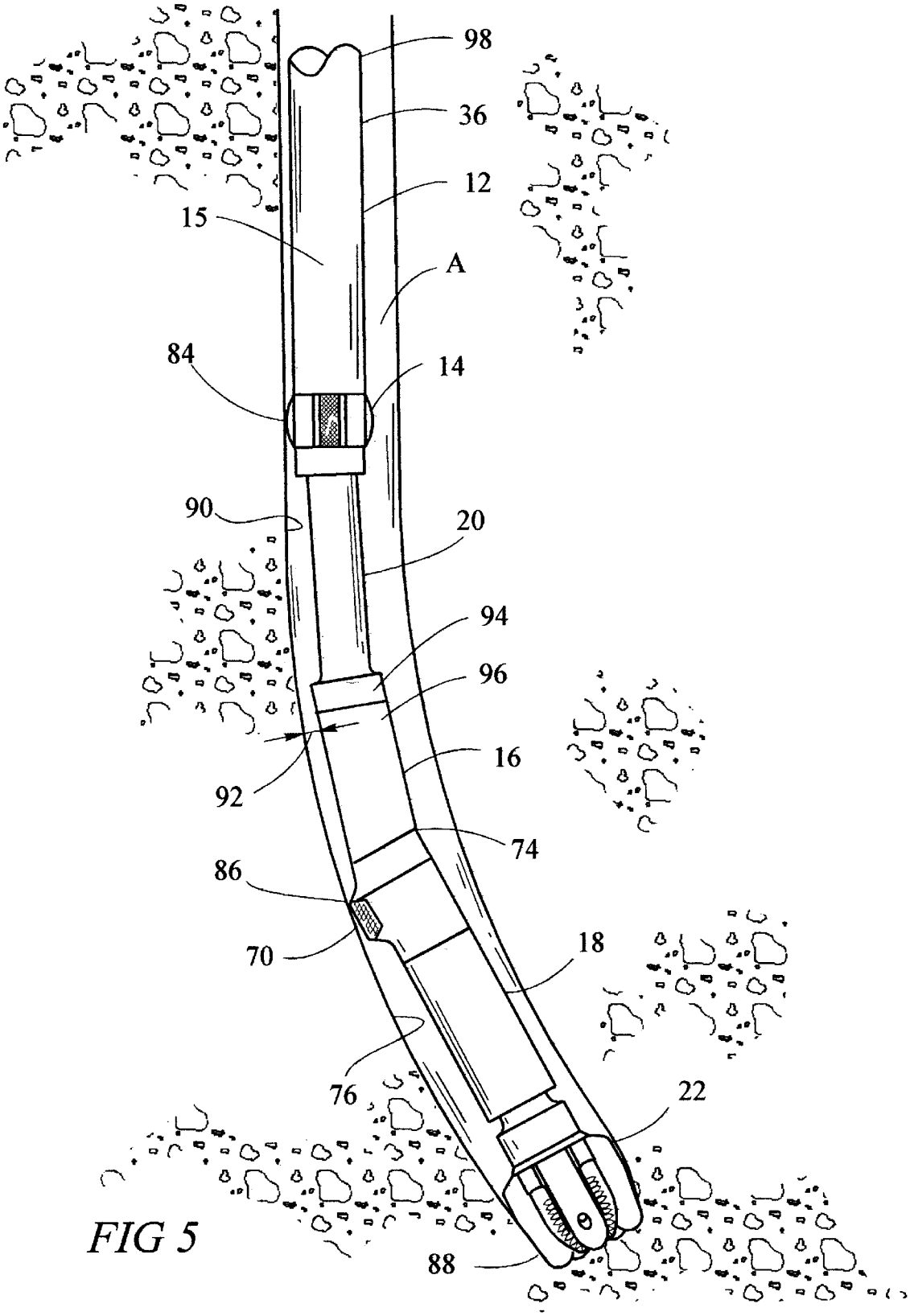
FIG. 5 illustrates the bottom hole assembly of the present invention passing through the build section of the well.

As shown in FIG. 5, high stresses are further applied to bottom hole assembly 10 due to the side loads placed on assembly 10 as the assembly 10 kicks off at kick off point B to initiate drilling lateral borehole A and as the assembly 10 drills the build section C. The build-up rate causes bottom hole assembly 10 to contact lateral borehole A at point 84 where stabilizer 14 engages the lower side 90 of borehole A, point 86 where the wear pad 70 of bent housing 16 contacts lower side 90, and point 88 where bit 22 contacts the lower side 90 of borehole A. Point 86 often serves as a fulcrum for bottom hole assembly 10 causing assembly 10 to drill the targeted build-up rate for forming build section C. Depending upon the bend of bent housing 16, the points of contact 84, 86, 88 cause borehole A to apply these side loads to bottom hole assembly 10

The flexible section 20 of the bottom hole assembly 10 allows the stiffness of bottom hole assembly 10 to be reduced in a controlled and predictable manner and allow build-up rates, which have been defined as intermediate radius, to increase well beyond what is normally considered medium radius and yet use conventional components in the bottom hole assembly 10 to avoid the articulated sections between component parts of the specialized assembly required for short radius wells. The flexible section 20 is designed to have a predetermined stiffness which minimizes the forces required to force assembly 10 through casing 26 to get to kick-off point B, reduces side loads to a manageable level at kickoff, enhances the effect of weight on bit on the build-up rate, and extends the allowable curvature in which the downhole motor 12 can be rotated. The following table compares the capabilities of a standard medium-radius bottom hole assembly to the bottom hole assembly 10 of the present invention:

| Motor | Max Build Rate | Allowable Dog Leg Severity for Rotation | Bit Side Load at Kickoff |
|---|---|---|---|
| 4¾ Standard Motor | 25 deg/100' | 15 | 5000 lb |
| 4¾ Present Invention | 60 deg/100' | 30 | 3000 lb |

Dog leg severity is how rapidly the dog leg is changing. The use of the flexible section 20 in the bottom hole assembly 10 increases the length of the assembly by about five feet (and therefore bit-to-sensor distance) and increases the sensitivity to some downhole parameters.

The stiffness of flexible section 20 is defined by the material from which it is made, the cross-section 48 of wall 49 determined by inside diameter 42 and outside diameter 44, and the length 46 of flexible section 20. These parameters are optimized for the particular size of bottom hole assembly being used for lateral borehole A. The size of the bottom hole assembly 10 is the nominal outside diameter of the assembly 10, such as diameter 92 of stator 36. Typical sizes for bottom hole assemblies are 3¾, 4¾, 6½ to 6¾, 7¾ to 8, and 9⅝ inches.

By "stiffness" is meant stiffness relative to the other components of the bottom hole assembly 10. The stiffness of flexible section 20 may be varied by selecting a material for flexible section 20 which has a Young's modulus that is lower than that for the steel used in making the other components of the bottom hole assembly 10. In addition, the stiffness of flexible section 20 can be varied by adjusting the thickness 48 of the wall 49 of housing 30 of section 20. For example, its stiffness can be reduced by making thickness 48 less than that for the other components of the bottom hole assembly 10 such as by reducing its outside diameter to a diameter less than the drilling motor nominal diameter and by increasing its inside diameter to a diameter greater than that of the drilling motor nominal diameterthus reducing the wall thickness to less than the drilling motor nominal thickness. Still further, the stiffness of flexible section 20 can be reduced by lengthening the housing 30 which adds flexibility. Although any combination of these parameters will achieve the desired stiffness of flexible section 20, it is preferred that the length 46 of housing 30 be as short as possible so as to reduce the overall length 28 shown in FIG. 4. The shorter the length 28, the higher the build-up rate which can be achieved by the bottom hole assembly 10.

One functional relationship between the parameters of the flexible section 20 is shown by the generic formula for a beam having a moment at each end. This formula is Deflection=$f(L^2/EI)$ where L is length 46 of flexible section 20, E is Young's Modulus for the material of flexible section 20, and I is the moment of inertia of flexible section 20 with a particular inside diameter 42 and outside diameter 44. The preferred material is beryllium copper whose Young's modulus is $19\times10^4$. The formula for the moment of inertia I is $I=(3.14159/64)\times(D_o^4-D_I^4)$ where $D_o$ is outside diameter 44 and $D_I$ is inside diameter 42. Young's modulus for titanium is $15\times10^4$, for aluminum $10\times10^4$, and for steel (4330) $29\times10^4$, should flexible section 20 be made of these materials. It should be appreciated that other materials may be used such as composite materials.

The characteristics of housing 30 are predetermined based on the maximum side load acceptable for the bottom hole assembly 10 with a maximum bend angle of 3 degrees to produce a build-up rate that will produce a lateral borehole A with an intermediate radius, i.e. a build-up rate between 20 and 70 degrees per 100 feet. The stiffness of flexible section 20 is determined so as to maintain the side loads on bottom hole assembly 10 less than the maximum side load which can be tolerated by the bottom hole assembly 10.

Initially, a base line build-up rate, which can be achieved using a conventional bottom hole assembly, is determined and then the side loads, to which the conventional bottom hole assembly will be subjected as it passes through the casing and during kick off, are determined. From these results, the maximum side load for the bottom hole assembly 10 is determined. Side load is viewed in terms of the stresses which are placed on the bottom hole assembly. The larger the increase in bend 74 or size of pad 70 to achieve a larger build-up rate, the greater the increase in side loads on the bottom hole assembly.

Having determined the maximum side load for a conventional bottom hole assembly, the components of bottom hole assembly 10 are defined using a defined bend angle for bend 74. The defined bottom hole assembly 10 includes the nominal inside and outside diameters of the stator housing 35, the flexible section 20, the bent housing 16, and the bearing assembly 18, including the relative lengths of each. The defined bottom hole assembly 10 also includes a definition of the stabilizer 14 and wear pad 70. The build-up rate which can be achieved by this defined bottom hole assembly 10 is then determined to determine the curvature of borehole A. The parameters of the flexible section 20 and the bend angles are then varied until the target build-up rates are achieved to produce the desired build section C. It is preferred to vary the materials and diameters of flexible section 20 to achieve an appropriate stiffness rather to add to its length. Once these have been achieved, the side loads on the bit 22 are determined using the ultimately defined bottom hole assembly 10 with the defined curvature of lateral borehole A. Empirical base line data or classical stress analysis is then used to determine whether those side loads are acceptable. If the side loads are not acceptable, then the parameters of the flexible section 20 are modified until the side loads are acceptable and the build-up rates produce the target build section C.

It should be appreciated that some components of the bottom hole assembly 10, such as the bearing assembly 18 and the downhole motor 12, include inner parts, such as the drive train, which are taken into account in determining their true stiffness because these inner parts tend to support the outer components. After these components are built, load cell testing is performed to calculate the equivalent inside diameter for that component. The density used is the total weight divided by the effective cross-section of the part. Although the rubber forming the lobes on housing 35 and rotor 54 conducts stiffness from the rotor 54 to housing 35, the stator housing 35 is the stiffest member of the power generation section 15. Therefore, the stiffness of flexible section 20 may be compared to the stiffness of stator housing 35 and should be less stiffness than stator housing 35.

Figure 2:
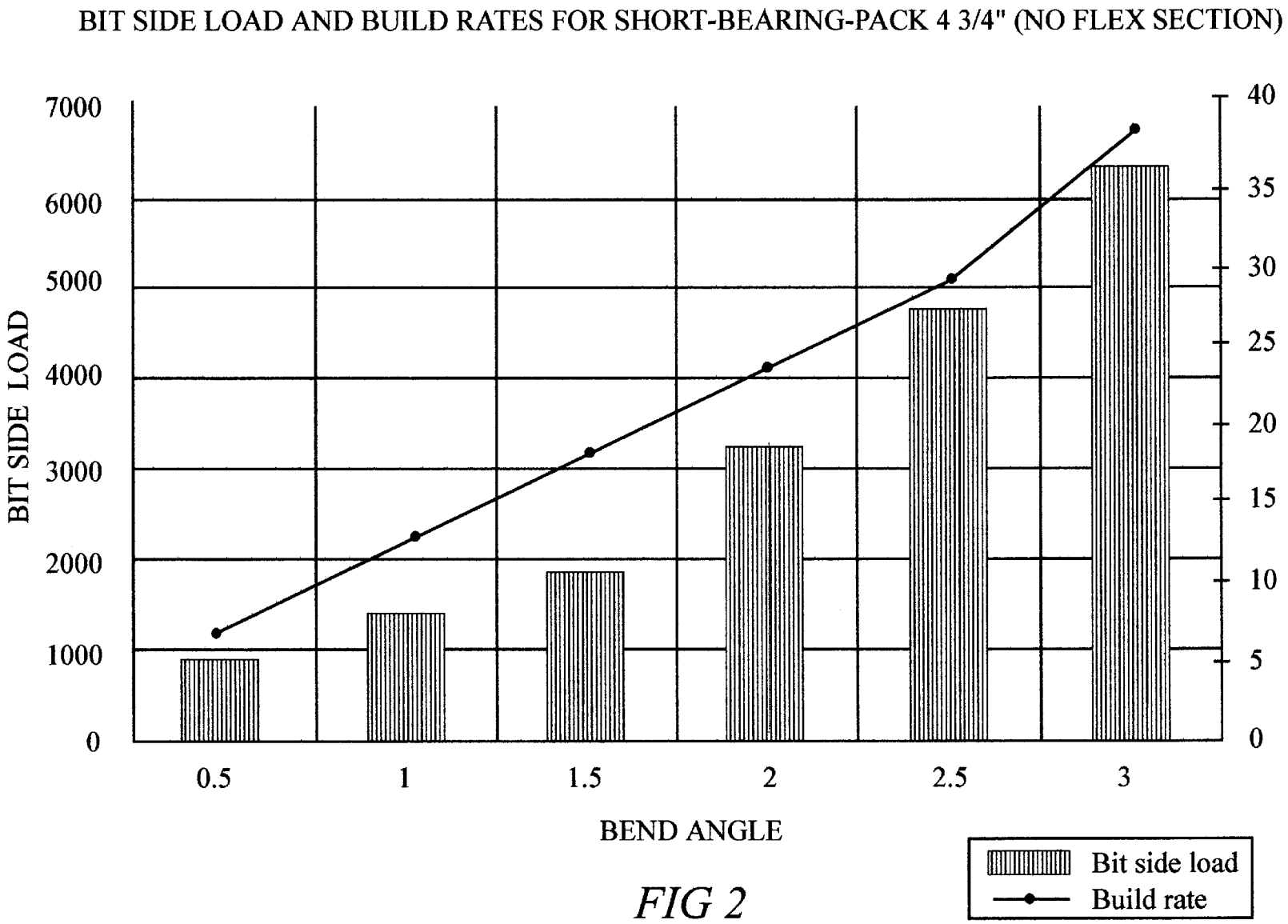
FIG. 2 is a graph of bit side loads versus bend angle for a conventional drilling motor.
Figure 3:
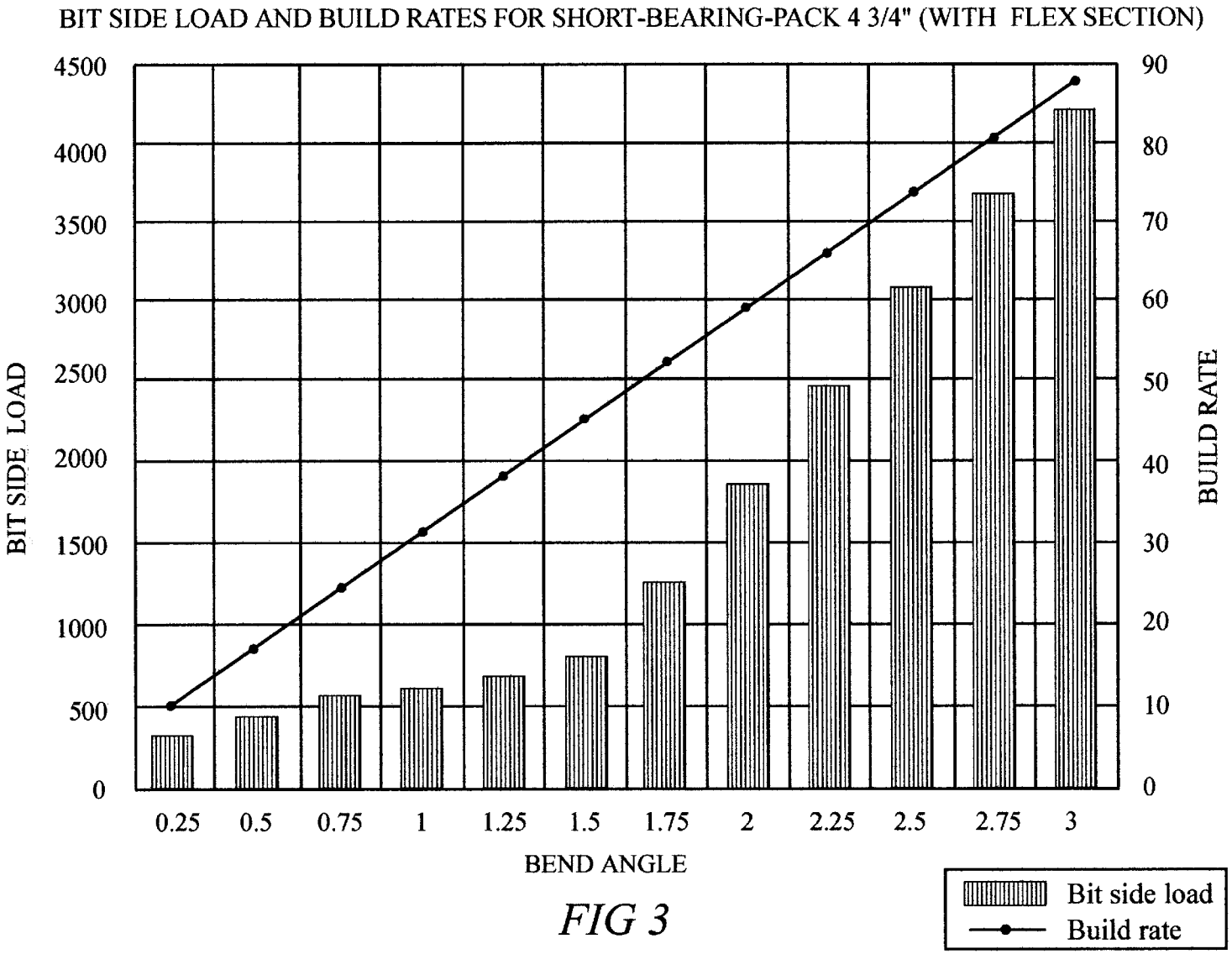
FIG. 3 is a graph of bit side loads versus bend angle for the bottom hole assembly of the present invention.

As previously discussed with respect to the thickness of rotor extension shaft 50, the torsional requirements and bending moments on the rotor extension shaft 50 must also be considered once the optimum parameters for the flexible section 20 have been determined. It is desirable to make the inside diameter 42 of flexible section 20 as small as possible, but as the inside diameter 42 is reduced, the diameter of shaft 50 must also be reduced. At some point, the diameter of shaft 50 becomes too small to meet torsional and bending moment requirements. To still achieve the target build-up rates, the flexible section 20 must then be lengthened to reduce stiffness and add flexibility. The lengths of the other components of the bottom hole assembly 10 are left the same because of the three point defined contact point geometry required to achieve the target build-up rates. As shown in FIG. 3, as compared to FIG. 2, the side loads are substantially reduced using the bottom hole assembly 10 of the present invention as compared to conventional downhole motors.

The following are the parameters for 4¾ and 3¾ sized bottom hole assemblies 10 having a flexible section 20 made of beryllium copper and where $I_R = I_{FLEX\ SECT}/I_{STATOR}$ and $E_R = E_{BeCu}/E_{Steel}$:

| Component | $D_O$ | $D_I$ | I | L | $I_R$ | $E_R$ |
|---|---|---|---|---|---|---|
| Flexible Section | 3.5" | 2.84" | 4.173 | 42" | | |
| Stator | 4.75" | 3.75" | 15.282 | | 0.273 | 0.66 |
| Flexible Section | 2.88" | 2.13" | 2.367 | 26" | | |
| Stator | 3.75 | 2.94" | 6.040 | | 0.392 | 0.66 |

Note the ratio R of $(E_{FLEX\ SECT} \times I_{FLEX\ SECT})/(E_{STATOR} \times I_{STATOR})$ which is the value $E_R I_R$. This EI product is a measure of the stiffness of any component and therefore the ratio of the EI products is a measure of the relative flexibility of the new component with respect to the standard component. Multiplying $E_R$ times $I_R$, the product value for the 4¾ size bottom hole assembly is 0.18 and for the 3¾ size bottom hole assembly is 0.26. It is estimated that for the range of common bottom hole assembly sizes, which is 2⅞" to 6¾", the EI value will range from 0.10 to 0.33. The EI value of the flexible section 20 is 33% or less than that of the stator housing 35.

In operation, the bottom hole assembly 10 with drill bit 22 are lowered through the bore 24 of casing 26. The bottom hole assembly 10 and bit 22 contact the inner diameter of casing 26 at contact points 78, 80, and 82 placing bending stresses and side loads on assembly 10. The amount of side load depends upon various factors including the length of the bottom hole assembly 10, the bend angle 74 of bent housing 16, and the stiffness of flexible section 20. The bend angle 74 is determined by the amount of build-up rate necessary to achieve the planned build section C shown in FIG. 1. It is preferred that the flexible section 20 remain the same through-out the range of bend angles 74 for the bent housing 16.

At the kick-off point B, the bottom hole assembly 10 is deviated from the vertical or straight cased borehole E and the drilling of lateral borehole A having build section C is initiated. Build section C has an intermediate radius, such as between 25 and 60 degrees per 100 feet build-up rate. As shown in FIG. 5, the bottom hole assembly 10 engages the borehole wall 76 at contact point 84 by stabilizer 14, at contact point 86 by wear pad 70 and at contact point 88 by the bit 22. As weight is placed on bit 22, the bottom hole assembly 10 flexes toward the low side 76 of borehole A due to the flexibility of flexible section 20 thus increasing build-up rate. Flexible section 20 allows wear pad 70 to act like a fulcrum forcing or kicking bit 22 toward the upper side of the borehole A thereby increasing build-up rate for the bit 22 to cut the desired curvature to form build section C. This action permits a tighter drilling radius. Flexible section 20 reduces both the static and cyclic stresses on the other components of the bottom hole assembly 10 as the assembly passes through casing 26, upon kicking off from the straight borehole, and upon increasing the build-up rate to drill the lateral borehole, all of which results in increased reliability and longer life of the bottom hole assembly 10. The present invention also allows the bottom hole assembly to be rotated in boreholes of 30 degrees per 100 feet or less allowing a degree of steerability or build-up rate control.

Although bottom hole assemblies are sensitive to weight on bit, it is preferred that the build-up rate remain substantially constant during the drilling of build section C without regard to the amount of weight on bit 22. Although theoretically weight on bit may be used to adjust the build-up rate, this method often provides an unpredictable build-up rate and is not desirable. Typically, the build-up rate varies as weight is applied on the bit because the bottom hole assembly flexes more and moves toward the lower side of the borehole. The bottom hole assembly 10 of the present invention is designed to minimize its sensibility to weight on bit. As shown in FIG. 5, the stabilizer 14 limits the amount of weight on bit by preventing the flexible section 20 from deflecting beyond a certain amount without regard to the amount of weight on bit. There is a clearance 92 between the upper end 96 of bent housing 14 and the lower side 76 of borehole A. As additional weight on bit is applied, clearance 92 becomes smaller or possibly closes altogether allowing the upper end 96 of bent housing 16 or the lower end 94 of section 20 to engage borehole 76 causing the bit 22 to raise or kick-off more. This is caused by the fulcrum at wear pad 70. The stabilizer 14, however, prevents lateral movement of the upper end 96 of bent housing 14 and stabilizes the build-up rate. The clearance 92 at the upper end 96 of bent housing 14 does not float laterally or axially. Further, the housing 36 of stator 12 will engage the wall of borehole A, such as point 98, to prevent further moment to be applied to the flexible section 20 on weight on bit is increased. Thus, the only sensibility to weight on bit is the flexure that is limited to flexible section 20.

Stabilizer 14 also provides configuration and flexibility to accommodate different build-up rates. In addition to changing the bend angle of the bent housing 16, the diameter of the stabilizer 14 may be changed such as by reducing its diameter to desensitize the weight on bit. Weight on bit can also be desensitized by lengthening length 46 of flexible section 20. If the length 46 is long enough, the lower end 94 of section 20 will engage the lower side 76 of borehole A.

Further, it should be appreciated that a wear pad may be used in place of stabilizer 14. Stabilizer 14 forms a complete outer diameter around the bottom hole assembly thereby reducing the clearance between the bottom hole assembly and the upper side of the borehole. If the stabilizer 14 contacts the upper side of the borehole, an additional side load is placed on the bottom hole assembly.

Figure 8:
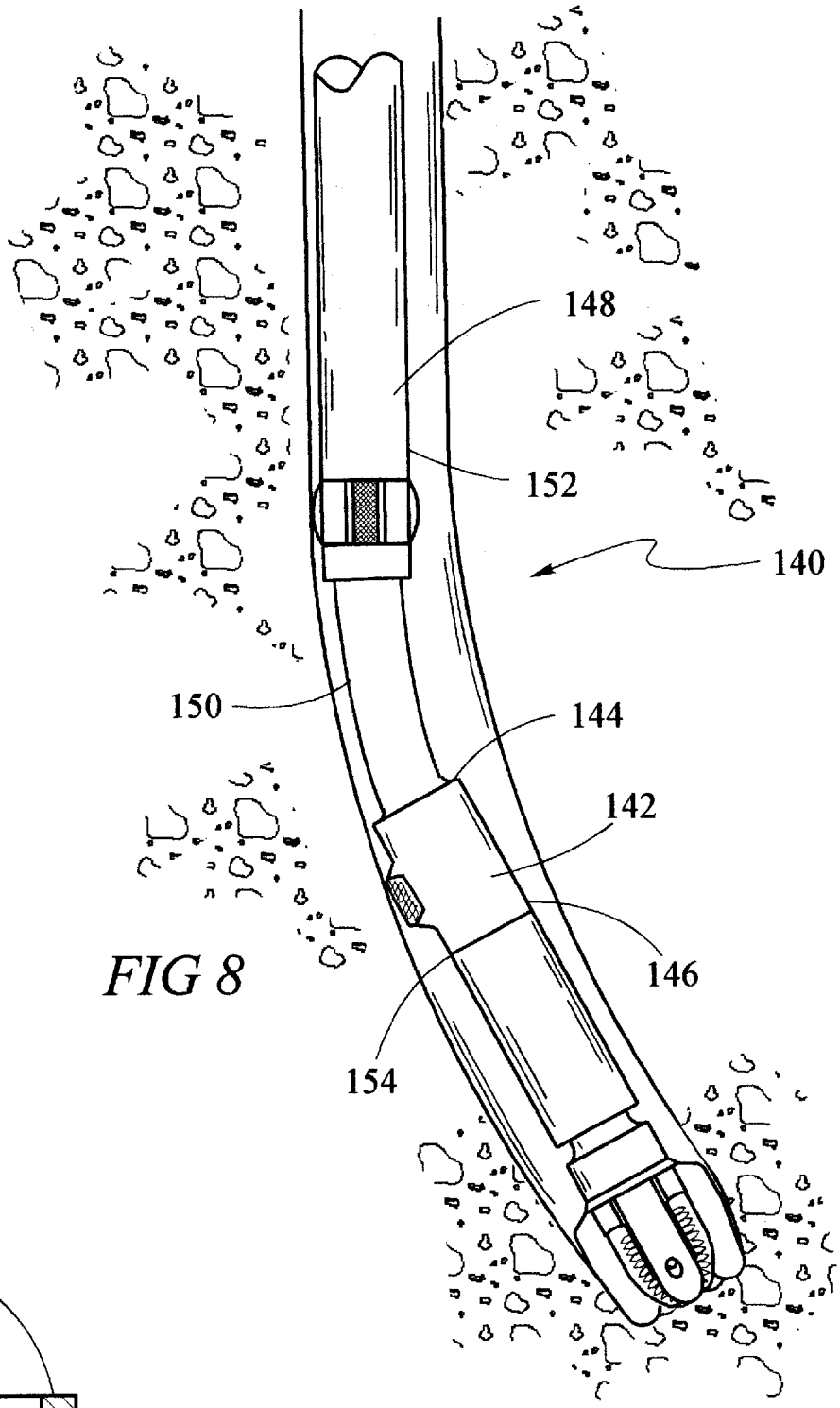
FIG. 8 illustrates an alternative embodiment of the bottom hole assembly of the present invention passing through the build section of the well with the flexible section integral with the bent housing.

Referring now to FIG. 8, the bottom hole assembly 140 illustrates the flexible section as an integral part of connecting rod or bent housing 142. Bent housing 142 includes a tubular housing 144 having a downhole section 146 with a nominal diameter substantially the same as the nominal diameter of power generation section 148 and an uphole flexible section 150 with a reduced cross-section so as to have less stiffness than the stator housing 152 of power generation section 148. The flexible section 150 is located between the power generation section 148 and the bend 154.

Figure 9:
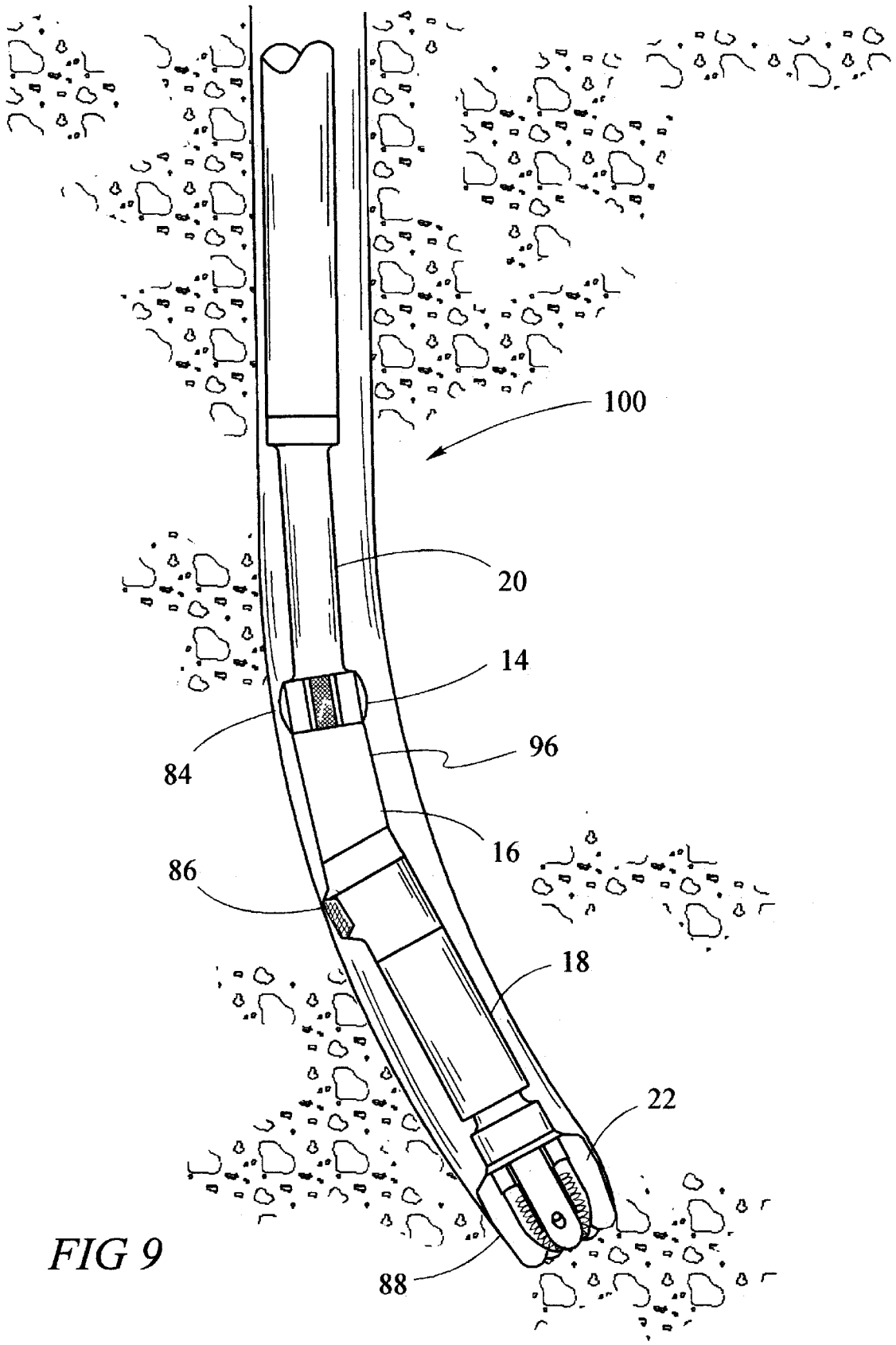
FIG. 9 illustrates an alternative embodiment of the bottom hole assembly of the present invention where the stabilizer is located between the flexible section and bent housing.

Referring now to FIG. 9, the bottom hole assembly 100 illustrates the stabilizer 14 disposed between the bent housing 16 and the flexible section 20. By moving the stabilizer 14 to a position below section 20 adjacent the downhole end of section 20, contact point 84 is also moved adjacent the upper end 96 of bent housing 16. This causes the three points of contact 84, 86, and 88 to be located below flexible section 20 in the rigid section of the bottom hole assembly 100 made up of bent housing 16, bearing assembly 18, and bit 22. Locating the stabilizer 14 below the flexible section 20 permits a more consistent build-up rate with weight on bit, because with a high build-up rate, the amount of weight on bit is unknown due to the binding and friction of the drill string extending to the surface through the borehole A and casing 26. In placing the stabilizer 14 below the flexible section 20, there is no clearance at 92 because stabilizer 14 will now contact lower side 76 at that point 86. This allows a higher build-up rate and does not allow bottom hole assembly 100 to have a lesser build-up rate. This is very desirable even though the build-up rate can no longer be varied once the bottom hole assembly 100 is in the borehole. Predictability of build-up rate is more desirable than the ability to vary or control build-up rate or to steer or correct build-up rate. By placing the stabilizer 14 below flexible section 20, the sensitivity to weight on bit is further reduced and eliminates the possibility of buckling between the stabilizer 14 and bent housing 16.

Figure 10:
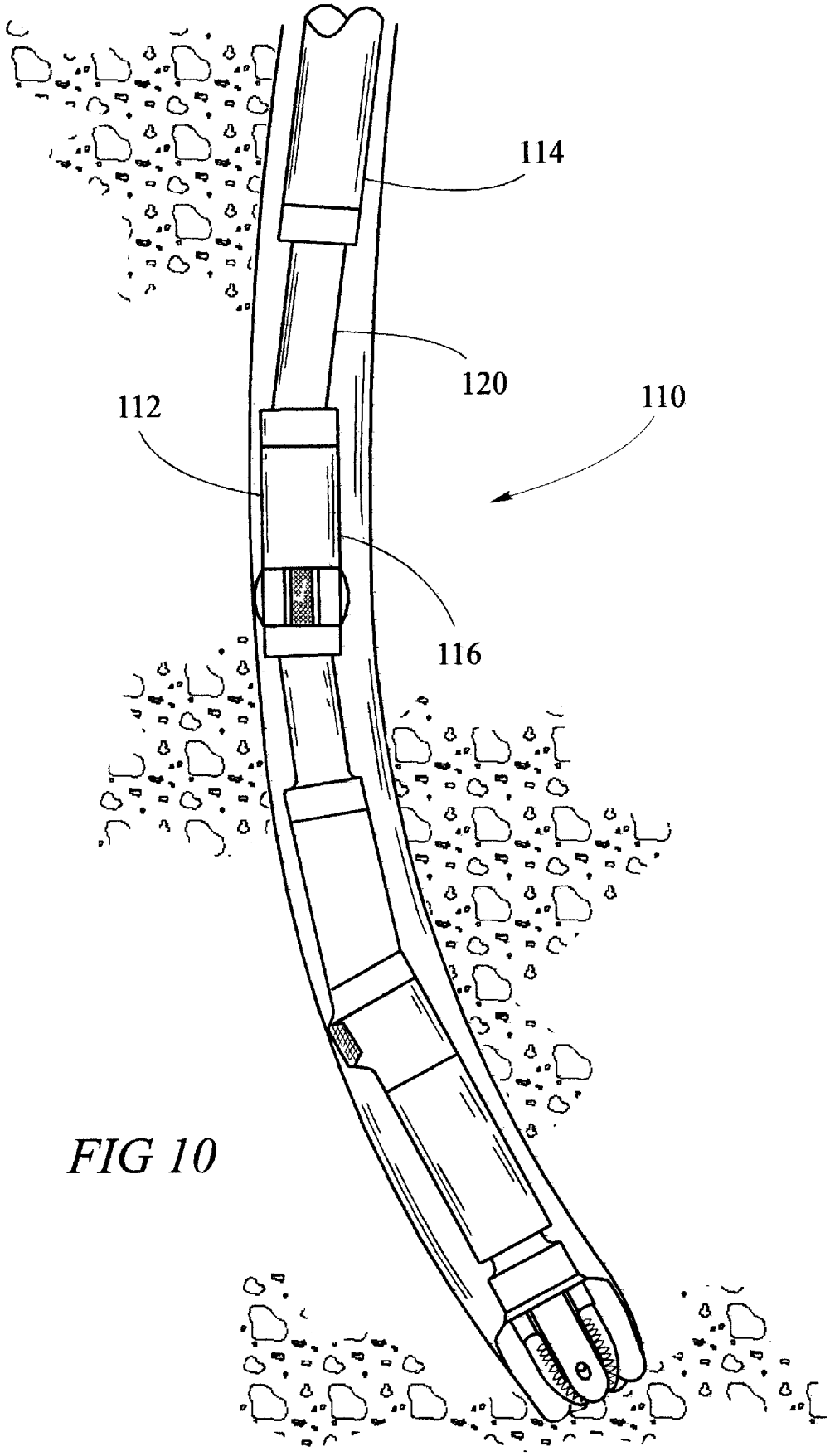
FIG. 10 illustrates an alternative embodiment of the bottom hole assembly of the present invention having a flexible section between the power sections of a tandem downhole motor.

Referring now to FIGS. 10 and 11, there is shown an alternative embodiment of the bottom hole assembly 110 with the downhole motor being a tandem motor 112, such as that disclosed in U.S. Pat. No. 5,620,056, incorporated herein by reference, having an upper power section 114 and a lower power section 116 with a flexible section 120 disposed therebetween. Section 120 connects the stator housings of upper and lower power sections 114 and 116 and may have an integral bend. Connecting rod 130 has a reduced outer diameter 132 to have sufficient flexibility to allow flexible section 120 bend at an angle of up to 3 degrees without excessive side loads. The inside diameter and length of connecting rod 130 may also be increased to reduce its stiffness. Connecting rod 130 may be made of a material having a Young's modulus which is less than that of the other components of the bottom hole assembly 110 to further reduce stiffness. By placing a flexible section 120 and flexible connecting rod 130 in the tandem motor 112, a more powerful downhole motor may be used in intermediate wells.

While a preferred embodiment of the invention has been shown and described, modifications thereof can be made by one skilled in the art without departing from the spirit of the invention.

We claim:

1. A bottom hole assembly for connection to a drill string for drilling directional wells at build-up rates between 20 and 70 degrees per hundred feet, comprising:

a drill bit operatively connected to a positive displacement drilling motor;

said motor having tubular housings including a power generation housing;

one of said housings having a bend downhole of said power generation housing for the purpose of deflecting said drill bit away from the axis of the drill string; and a flexible section between said power generation housing and said bend for purposes of reducing side loads on said drill bit and increasing build-up rate capability of the bottom hole assembly.

2. The bottom hole assembly of claim 1 wherein said power generation housing includes a stator housing and said flexible section has less stiffness than said stator housing.

3. The bottom hole assembly of claim 2 wherein said flexible section comprises a tubular member formed from a material having a Young's modulus lower than that of the material of said stator housing.

4. The bottom hole assembly of claim 2 wherein said flexible section comprises a tubular member with a wall having a reduced wall thickness less than that of said stator housing.

5. The bottom hole assembly of claim 2 wherein said flexible section comprises a tubular member having an outer diameter which is less than that of said stator housing.

6. The bottom hole assembly of claim 2 wherein said flexible section comprises a tubular member having an inner diameter which is greater than that of said stator housing.

7. The bottom hole assembly of claim 2 wherein said flexible section comprises a tubular member formed of a material and having a wall with an inner and outer diameter which produces an EI value that is less than that of said stator housing.

8. The bottom hole assembly of claim 7 wherein said EI value is 33% or less than that of said stator housing.

9. The bottom hole assembly of claim 1 wherein said flexible section comprises a tubular member formed of a material and having a wall with an inner and outer diameter and a length which produces a stiffness that is less than the stiffness of said stator housing.

10. The bottom hole assembly of claim 1 further including a contact member disposed adjacent one end of said flexible member for engaging the lower side of the well.

11. The bottom hole assembly of claim 10 wherein said contact member is disposed on the uphole end of said flexible section.

12. The bottom hole assembly of claim 8 wherein said contact member is disposed on the downhole end of said flexible member.

13. The bottom hole assembly of claim 1 wherein said housing includes a wear member for contacting the lower side of the well, said wear member extending past the outside diameter of the bottom hole assembly for protecting the bottom hole assembly from abrasive wear.

14. The bottom hole assembly of claim 1 wherein said power generation housing has a nominal size of substantially 3¾ inches and said flexible section is made of beryllium copper, has a maximum outer diameter of substantially 2.9 inches, a minimum inner diameter of substantially 2.1 inches, and a length of at least 26 inches.

15. The bottom hole assembly of claim 1 wherein said power generation housing has a nominal size of substantially 4¾ inches and said flexible section is made of beryllium copper, has a maximum outer diameter of substantially 3.5 inches, a minimum inner diameter of substantially 2.8 inches, and a length of at least 42 inches.

16. The bottom hole assembly of claim 1 wherein said flexible section is a separate housing between said power generation housing and said housing with said bend.

17. The bottom hole assembly of claim 1 wherein said flexible section is integral with said housing with said bend.

18. The bottom hole assembly of claim 1 wherein said motor is a tandem motor with at least two power generation housings connected by a flexible housing with a stiffness less than that of said power generation housings.

19. The bottom hole assembly of claim 18 wherein said flexible housing between said two power generation housings has an integral bend.

* * * * *